US008266829B2

(12) United States Patent
Ma et al.

(10) Patent No.: US 8,266,829 B2
(45) Date of Patent: Sep. 18, 2012

(54) FASTENING DEVICE FOR SYSTEM IRONS

(75) Inventors: Mun Thoh Ma, Singapore (SG); Chandra Mohan Janakiraman, Singapore (SG); Ronald Albert Plantinga, Eindhoven (NL); L Bouhuys, Amsterdam (NL); Wa Chu, Singapore (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 274 days.

(21) Appl. No.: 12/601,323

(22) PCT Filed: May 30, 2008

(86) PCT No.: PCT/IB2008/052109

§ 371 (c)(1),
(2), (4) Date: Apr. 29, 2010

(87) PCT Pub. No.: WO2008/146254

PCT Pub. Date: Dec. 4, 2008

(65) Prior Publication Data

US 2010/0199529 A1 Aug. 12, 2010

(30) Foreign Application Priority Data

May 31, 2007 (EP) ..... 07109301

(51) Int. Cl.
*D06F 75/40* (2006.01)
*D06F 79/02* (2006.01)

(52) U.S. Cl. ..... 38/96; 248/117.6

(58) Field of Classification Search ..... 38/79, 96, 38/77.6; 219/246, 259; 248/117.1–117.7; D32/73

See application file for complete search history.

(56) References Cited

U.S. PATENT DOCUMENTS

| | | | | | |
|---|---|---|---|---|---|
| 1,759,214 | A | * | 5/1930 | Winters | 248/117.1 |
| 2,460,044 | A | * | 1/1949 | Tomey | 248/117.7 |
| 2,657,000 | A | * | 10/1953 | Tonks | 248/117.6 |
| 3,062,492 | A | * | 11/1962 | Hedger | 248/117.1 |
| 3,162,415 | A | * | 12/1964 | St Pierre | 248/117.6 |
| 3,176,947 | A | * | 4/1965 | Inverso | 248/117.6 |
| 4,368,863 | A | * | 1/1983 | Gentile | 248/117.7 |
| 5,108,056 | A | * | 4/1992 | McBounds | 248/117.4 |
| 5,414,945 | A | | 5/1995 | Freeman et al. | |
| 6,068,222 | A | | 5/2000 | Stangeland | |
| 6,116,550 | A | | 9/2000 | Forbes | |
| 6,226,904 | B1 | | 5/2001 | Brady et al. | |

FOREIGN PATENT DOCUMENTS

| | | |
|---|---|---|
| EP | 0713938 | 5/1996 |
| EP | 1612320 | 1/2006 |
| ES | 1055003 | 9/2003 |
| GB | 1208192 | 10/1970 |
| JP | 2000005499 | 1/2000 |
| WO | WO2006027464 | 3/2006 |

* cited by examiner

*Primary Examiner* — Ismael Izaguirre

(57) ABSTRACT

A system iron comprises an iron and a base that has a receiving area for receiving the iron. The base comprises a fastening device for fastening the iron to the base. The fastening device includes a first engagement member and a second engagement member arranged at mutually opposite sides of the receiving area. At least one of the engagement members is displaceable in a direction away from the other engagement member and is biased towards the other engagement member. With such a fastening device, a user can safely and conveniently lock the iron to the base using just one of his hands for gripping the main grip portion of the iron.

7 Claims, 4 Drawing Sheets

FASTENING DEVICE FOR SYSTEM IRONS

FIELD OF THE INVENTION

This invention relates to system irons, more in particular to a fastening device for the system irons.

BACKGROUND OF THE INVENTION

After an ironing operation, a system iron including an iron and a base is carried to be kept in a cabinet or the like until next use. At the time of transport, if the iron is not fastened to the base properly, there is a possibility of the iron and the base getting apart and falling down. In order to prevent this, it is necessary to make sure of sufficient coupling before transporting the system iron. In conventional system irons care must be taken when placing the iron on the base and fastening the iron to the base as there may be a chance of a user touching the hot iron.

WO2006027464 describes an ironing appliance comprising an iron and a portable base provided with a surface for setting down the iron. The iron comprises a soleplate on which a body with an integrated handle is mounted. The base comprises means for immobilising the iron. The means engages with the body of the iron upstream and downstream of the handle in such a way that the entire ironing appliance can be transported with the help of the handle of the iron. This ironing appliance involves moving a rotating restraining means to engage a front part of the iron. In the process of fastening the iron to the base, the user's hand might be too close to the soleplate and the user might touch the hot soleplate accidentally.

It is therefore an object of the invention to provide a system iron that does not have the disadvantages described above, more in particular to provide a safe and convenient fastening feature for the system iron.

SUMMARY OF THE INVENTION

In order to achieve this object, the invention proposes a system iron which comprises an iron and a base having a receiving area for receiving the iron, wherein the base comprises a fastening device for fastening the iron to the base and wherein the fastening device includes a first engagement member and a second engagement member arranged at mutually opposite sides of the receiving area, wherein at least one of the engagement members is displaceable in a direction away from the other engagement member and is biased towards the other engagement member. With such a fastening device, a user can safely and conveniently lock the iron to the base using just one of his hands for gripping the main grip portion of the iron. With the grip portion of the iron in his hand, the user first urges the iron against the displaceable engagement member to move said member away from the other engagement member. Subsequently, the user places the iron between the two engagement members, and releases the movable engagement member again. As a result, the movable engagement member is biased back towards the other engagement member, so that the iron is clamped between the two engagement members. When doing so, the user's hands do not come close to the hot soleplate, so that the risk of contact of the user's hand with the soleplate is very small. The invention also allows free access to the handle of the iron for the transportation of the system iron, and also uses the solidity of the iron with the integrated handle to support the entire weight of the system iron during transport.

According to another embodiment of the invention, the engagement members are arranged to engage a front and a rear part of the iron. This engagement ensures a stable engagement between the iron and the engagement members during transportation.

According to a further embodiment of the invention, the displaceable engagement member is arranged to engage the front part of the iron. The front part of the iron usually has a pointed design. By providing the displaceable engagement member with a matching design, a precise positioning of the iron on the base is achieved.

According to yet another embodiment of the invention, the engagement members are configured and arranged to engage a sole plate of the iron. The engagement members can engage not only the front part of the iron but also the front part of the soleplate. This ensures a strong coupling between the iron and the base and also a safe and simple fastening.

According to a still further embodiment of the invention, the fastening device comprises a locking means to lock the displaceable engagement member in a locked position engaging the iron. The locking means improve the safety of the fastening device, because the displaceable engagement member is prevented from accidental displacements by said locking means.

According to another embodiment of the invention, the base comprises a steam generator for generating steam required for an ironing operation. The steam generated in the steam generator is sent to the iron through a hose. The steam helps in removing creases from a garment to be ironed. As compared to a classical iron, the system iron is heavy as it has a steam generator. The above mentioned fastening ensures the safe handling of the system iron.

According to a further embodiment of the invention, the base is a portable base and the fastening device therein facilitates the system iron to be transportable as a single unit. This enables the system iron to be transported and stored safely after an ironing operation.

DETAILED DESCRIPTION OF EMBODIMENTS

Figure 1:
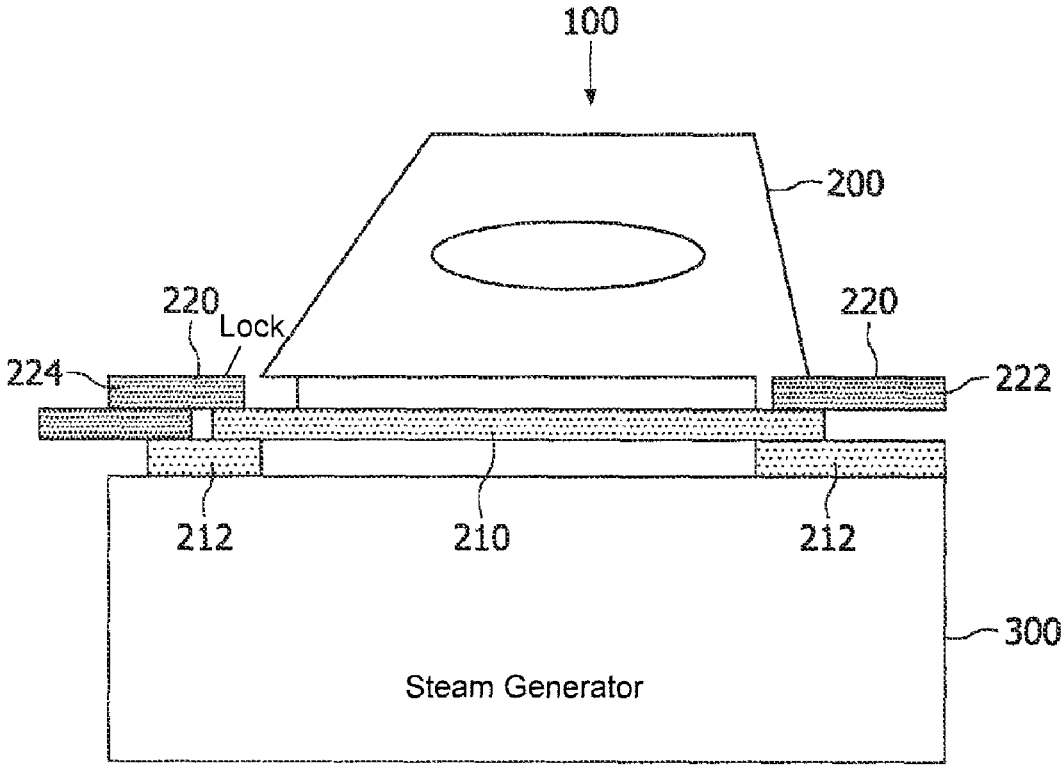
FIG. 1 shows a system iron according to one embodiment of the invention.

The present invention will be described with respect to particular embodiments and with reference to certain drawings, but the invention is not limited thereto. Any reference signs in the claims shall not be construed as limiting the scope. The drawings described are only schematic and are non-limiting. In the drawings, the size of some of the elements may be exaggerated and not drawn to scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

As shown in FIG. 1, the system iron 100 includes an iron 200, a base 300. The iron has a soleplate 210 and the base 300 includes a fastening device 220 which in turn comprises a displaceable engagement member 224 for engaging the front part of the iron 200 (hereinafter referred as displaceable engagement member), an engagement member 222 for engaging the rear part of the iron 200 (hereinafter referred to as rear engagement member). The iron 200 rests on heat resistant resting pads 212.

Figure 2:
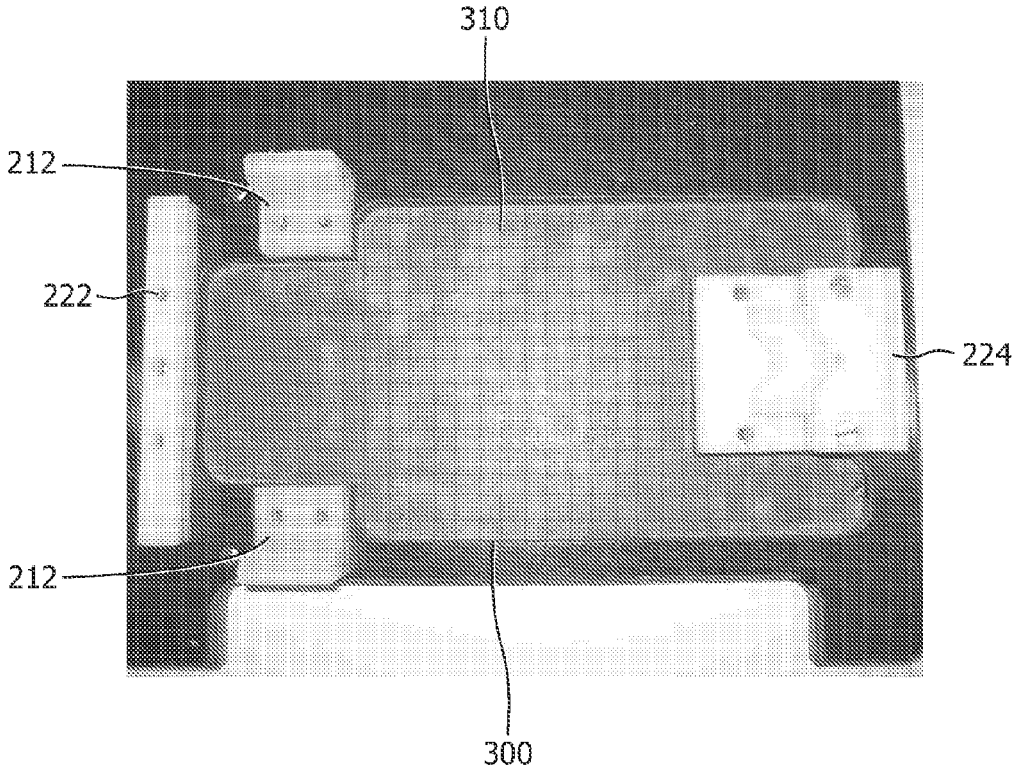
FIG. 2 shows a base with a fastening device of the system iron of FIG. 1.

In FIG. 2, the base 300 is shown without the iron 200. The displaceable engagement member 224 and the rear engagement member 222 are configured to engage the iron 200 with the base 300.

Figure 3:
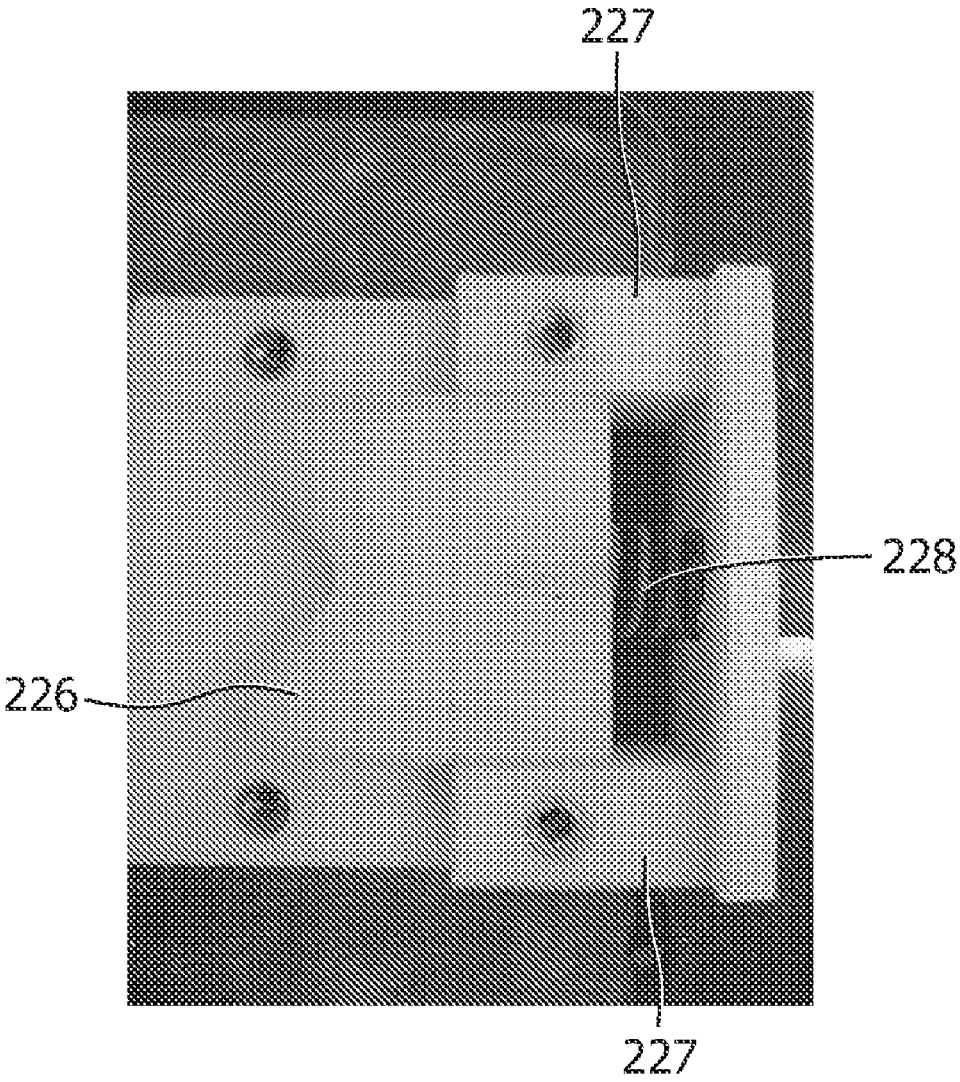
FIG. 3 shows a displaceable engagement member of the system iron of FIG. 1.

FIG. 3 is the close up of the front displaceable engagement member 224. It includes a movable element 226, a guide 227 and a compression spring 228.

Figure 4:
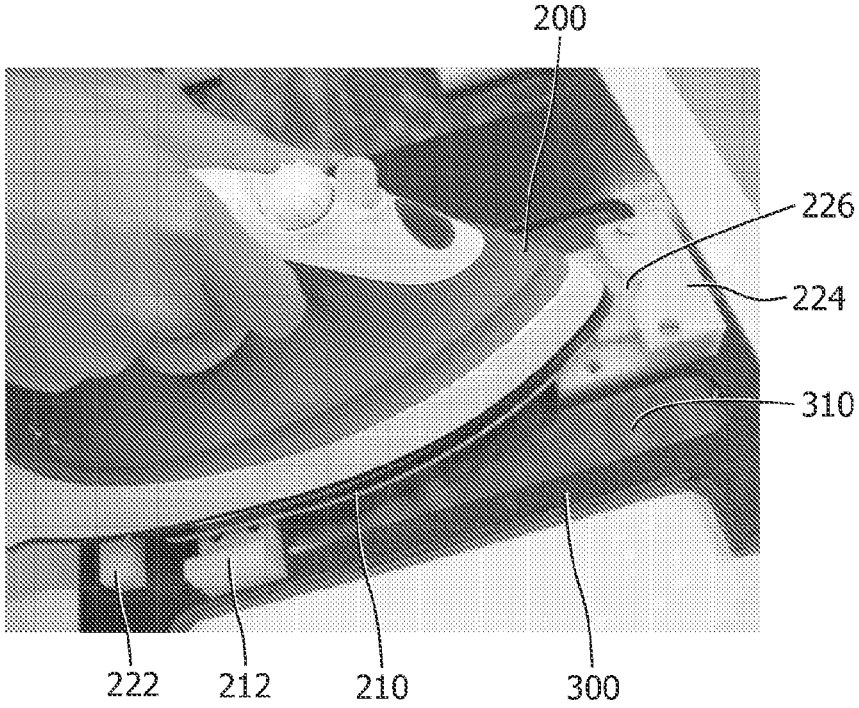
FIG. 4 shows engagement of a front part of an iron to a base of the system iron.
Figure 5:
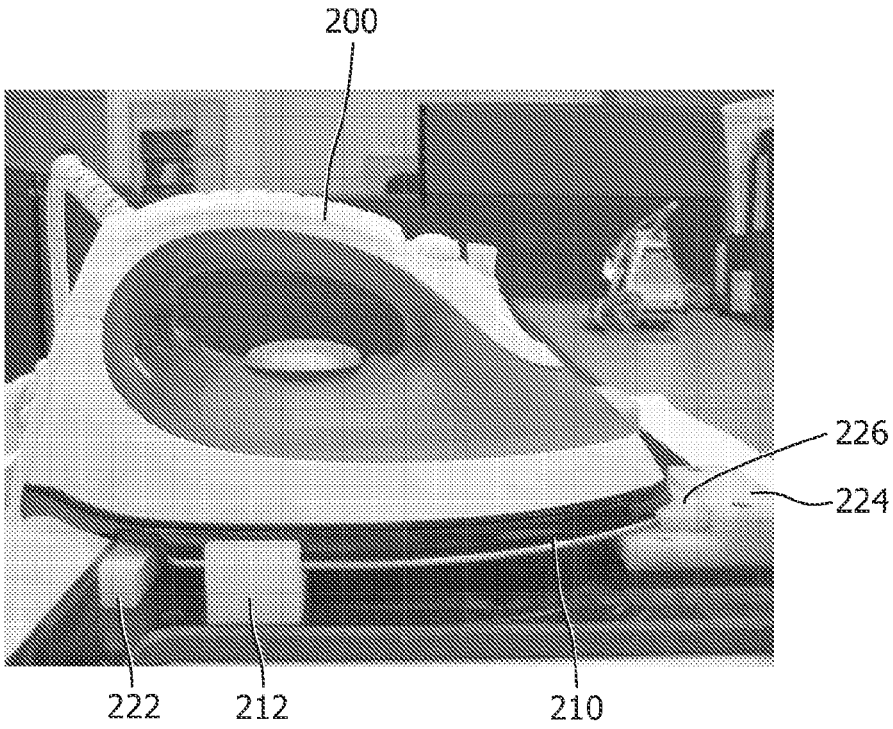
FIG. 5 shows the iron of FIG. 4 that is engaged with the base.

FIG. 4 shows engagement of front part of the iron 200 to the base 300 by fastening the soleplate 210 of the iron, whereas FIG. 5 shows the system iron 100 in which the iron 200 is engaged with the base 300.

As shown in FIG. 4, the user first engages the front part of the soleplate 210 by pushing the moveable element 226 of the displaceable engagement member 224 away from the rear engagement member 222. The displaceable engagement member 224 includes guides 227 for guiding the movement of the moveable element 226 in a substantial straight movement. The compression spring 228 is provided for maintaining an engaging force that is sufficient to lock the soleplate 210 to the base 300. The moveable element 226 is pushed forward to a position such that the iron 200 sits between the displaceable engagement member 224 and the rear engagement member 222. In this position, the user will gradually release his hold against the spring force exerted by the compression spring 228 that is pushing against the iron 200, thus moving the soleplate 210 gradually backwards to engage the rear engagement member 222. The rear engagement member 222 has a shoulder configured for anchoring the rear of the soleplate 210. When the soleplate 210 has engaged with the rear engagement member 222, the fastening of the iron 200 to the base 300 is accomplished as shown in FIG. 5. It is possible to provide additional locking means (not shown) to the displaceable engagement member to fix it in the locking position to prevent accidental release of the iron 200 due to external influence e.g. vibration. Thus the user can safely and conveniently lock the iron 200 to the base 300 using just one of his hands for gripping the main grip portion of the iron 200. When doing so, the user's hands do not come close to the hot soleplate 210, so that the risk of contact of the user's hand with the soleplate 210 is very small.

It is also possible for the displaceable engagement member 224 to engage the front part of the housing of the iron 200 instead of the front tip of the soleplate 210.

In a preferred embodiment, the base 300 is part of a stand (not shown) of the system iron 100. In the engaged position, the iron 200 and the base 300 can be transported as a single unit by holding onto the handle of the iron 200.

In another preferred embodiment, the base 300 is part of a stand of a cordless iron. The stand of the cordless includes a charging unit to electrically charge the iron when it is returned to the stand for charging.

In yet another preferred embodiment, the base 300 is part of a stand of an ironing board.

It is to be understood that although preferred embodiments, specific constructions and configurations have been discussed herein according to the present invention, various changes or modifications in form and detail may be made without departing from the scope and spirit of this invention.

The invention claimed is:

1. A system iron comprising:

an iron having a front, a rear, a sole late and a handle; and a portable base having a receiving area for receiving the iron, a fastening device for fastening the iron to the base to enable the iron and the base to be carried by the handle, and a first engagement member for receiving the front or the rear and having a movable element, a guide, and a compression spring and a second engagement member for receiving the front or the rear, the first and second engagement members are arranged at mutually opposite sides of the receiving area, wherein the movable element of the first engagement member is displaceable along the guide in a direction away from the second engagement member and the first engagement member is biased towards the second engagement member.

2. The system iron of claim 1, wherein the first and second engagement members are respectively arranged to engage a front part and a rear part of the iron.

3. The system iron of claim 2, wherein the displaceable first engagement member is arranged to engage the front part of the iron.

4. The system iron of claim 1, wherein the first and second engagement members are configured and arranged to engage the sole plate of the iron.

5. The system iron of claim 1, wherein the fastening device comprises a lock to lock the displaceable first engagement member in a locked position for engaging the iron.

6. The system iron of claim 1, further comprising a steam generator for generating steam required for an ironing operation.

7. The system iron of claim 1, wherein the base is a portable base and wherein the fastening device facilitates the system iron to be transportable as a single unit.

* * * * *